US010987787B2

(12) United States Patent
Miller

(10) Patent No.: US 10,987,787 B2
(45) Date of Patent: Apr. 27, 2021

(54) ADJUSTABLE LIGHT ATTACHMENT FOR EXTENSION TOOL

(71) Applicant: Alan Flick Miller, Dayton, OH (US)

(72) Inventor: Alan Flick Miller, Dayton, OH (US)

( * ) Notice: Subject to any disclaimer, the term of this patent is extended or adjusted under 35 U.S.C. 154(b) by 0 days.

(21) Appl. No.: 16/802,647

(22) Filed: Feb. 27, 2020

(65) Prior Publication Data

US 2020/0290187 A1 Sep. 17, 2020

Related U.S. Application Data

(60) Provisional application No. 62/818,901, filed on Mar. 15, 2019.

(51) Int. Cl.

| | |
|---|---|
| ***B25B 23/18*** | (2006.01) |
| ***F21V 21/088*** | (2006.01) |
| ***F21V 21/14*** | (2006.01) |
| ***B25B 13/48*** | (2006.01) |
| ***B25B 23/00*** | (2006.01) |
| ***B25B 13/46*** | (2006.01) |
| ***F21W 131/00*** | (2006.01) |

(52) U.S. Cl.

CPC ..... *B25B 23/18* (2013.01); *B25B 13/481* (2013.01); *B25B 23/0007* (2013.01); *F21V 21/0885* (2013.01); *F21V 21/145* (2013.01); *B25B 13/462* (2013.01); *F21W 2131/00* (2013.01)

(58) Field of Classification Search

CPC ... B25B 23/18; B25B 23/0007; B25B 13/481; F21V 21/0885; F21V 21/145

USPC ..... 362/120

See application file for complete search history.

(56) References Cited

U.S. PATENT DOCUMENTS

| | | | | | |
|---|---|---|---|---|---|
| 3,919,541 | A * | 11/1975 | Chao | B25B 23/18 | 362/120 |
| 4,480,295 | A * | 10/1984 | Shuster | B25B 23/18 | 200/60 |
| 5,785,408 | A * | 7/1998 | Tseng | F21L 15/14 | 362/119 |
| 5,845,986 | A * | 12/1998 | Breen | B25B 23/18 | 362/119 |
| 5,894,766 | A * | 4/1999 | Yang | B25B 13/481 | 81/60 |
| 6,022,121 | A * | 2/2000 | Lin | B25B 23/18 | 362/119 |
| 6,116,747 | A * | 9/2000 | Grawemeyer | B25B 23/0021 | 362/109 |
| 7,066,615 | B2 * | 6/2006 | Diggle, III | B25B 23/18 | 362/119 |

(Continued)

*Primary Examiner* — Bryon T Gyllstrom

(74) *Attorney, Agent, or Firm* — Frost Brown Todd LLC

(57) ABSTRACT

A method of illuminating a target area and driving rotation a driven tool comprises coupling a light attachment assembly to an elongated extension member by placing a portion of the elongated extension member within a hollow portion of a sheath of the light attachment assembly. Activating a light source of the light attachment assembly. Positioning the driven tool within the target area while grasping the light attachment assembly. Driving rotation of both the driven tool and the elongated extension member while grasping the light attachment assembly when the driven tool is positioned within the target are such that the portion of the elongated extension member housed within the hollow portion of the sheath rotates relative to the light assembly.

8 Claims, 15 Drawing Sheets

(56) References Cited

U.S. PATENT DOCUMENTS

| | | | | |
|---|---|---|---|---|
| 8,567,291 | B2 * | 10/2013 | Moreau | B25B 15/02<br>81/180.1 |
| 2002/0105794 | A1 * | 8/2002 | Hanscom | F21V 33/0084<br>362/602 |
| 2002/0105796 | A1 * | 8/2002 | Naghi | F21V 33/0084<br>362/120 |
| 2002/0105797 | A1 * | 8/2002 | Navid | B25B 23/18<br>362/120 |
| 2018/0021930 | A1 * | 1/2018 | Portaro | B25B 15/02<br>362/183 |

* cited by examiner

ADJUSTABLE LIGHT ATTACHMENT FOR EXTENSION TOOL

PRIORITY

This application claims priority to and benefit of U.S. Provisional Patent Application No. 62/818,901 entitled "Adjustable Light Attachment for Extension Tool," filed Mar. 15, 2019.

BACKGROUND

Extension tools are used in various situations. For example, an extension tool may be used to couple a socket (or various other tools) with a driving mechanism (e.g. a ratchet, impact wrench, drill, etc.) such that the extension tool extends between the socket and the driving mechanism. An extension tool may allow the socket to reach and fit onto a nut or bolt located at a desired location such that the driving mechanism may rotate the socket (and the extension tool) to provide torque to the nut or bolt. An extension tool may allow an operator to access difficult-to-reach locations, such as a bolt or fastener housed within a recessed location having insufficient space to accommodate the driving mechanism. Extension tools may be interchangeable with a driving mechanism such that an operator may use a first extension tool and socket with the driving mechanism to reach a first desired location, then use a second extension tool and socket with the same driving mechanism to reach a second desired location. Various extension tools may have various dimensions compared to each other, such as length and cross-sectional area, in order to accommodate various situations in which the operator may encounter.

While various kinds of extension tools have been made and used, it is believed that no one prior to the inventor(s) has made or used the invention described in the appended claims.

BRIEF DESCRIPTION OF THE DRAWINGS

While the specification concludes with claims which particularly point out and distinctly claim this technology, it is believed this technology will be better understood from the following description of certain examples taken in conjunction with the accompanying drawings, in which like reference numerals identify the same elements and in which:

Figure 1:
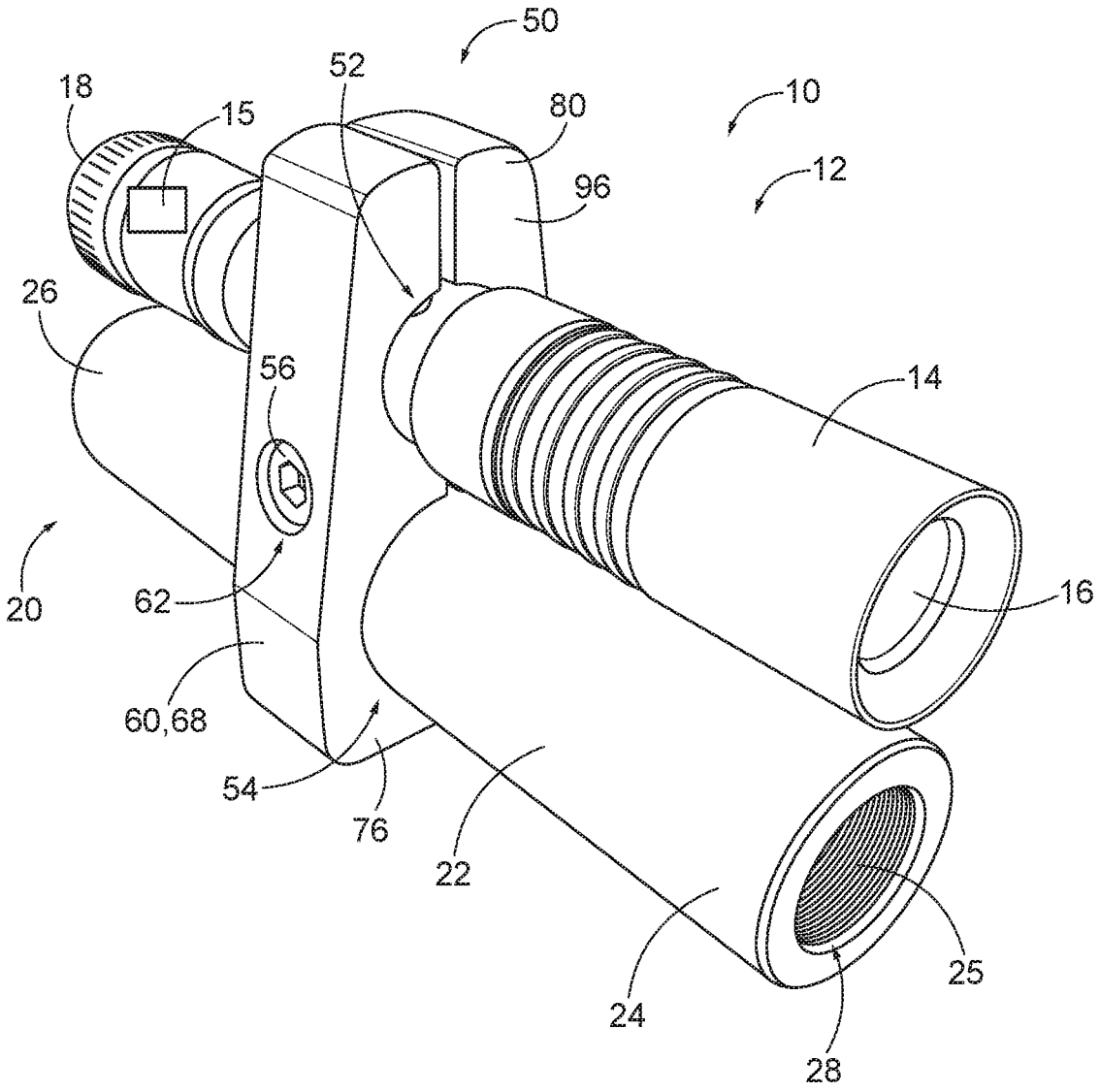
FIG. 1 depicts a perspective view of an exemplary light attachment assembly that may readily couple with an extension tool.
Figure 2:
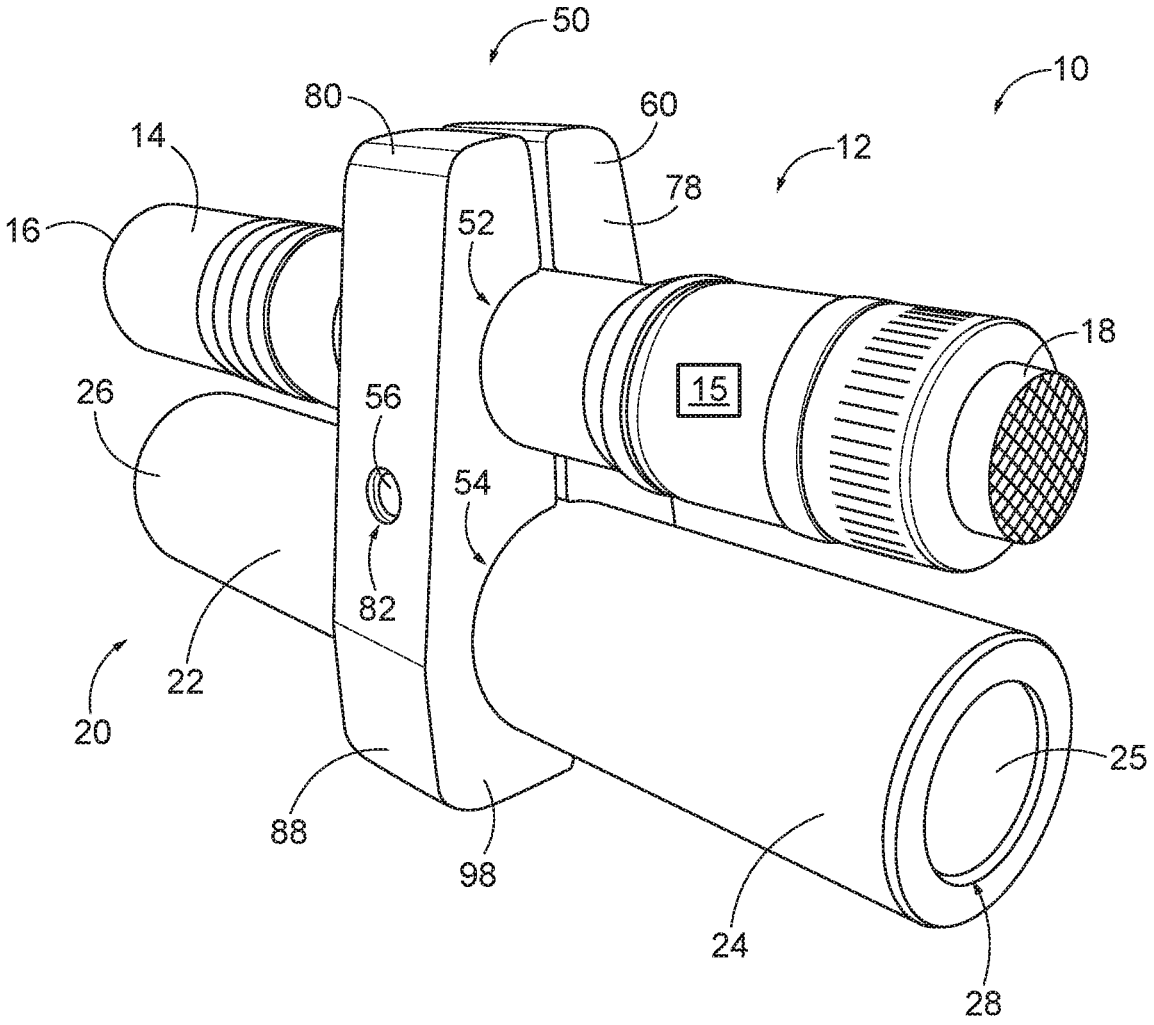
FIG. 2 depicts another perspective view of the light attachment assembly of FIG. 1.

The drawings are not intended to be limiting in any way, and it is contemplated that various embodiments of the technology may be carried out in a variety of other ways, including those not necessarily depicted in the drawings. The accompanying drawings incorporated in and forming a part of the specification illustrate several aspects of the present technology, and together with the description serve to explain the principles of the technology; it being understood, however, that this technology is not limited to the precise arrangements shown.

DETAILED DESCRIPTION

The following description of certain examples of the technology should not be used to limit its scope. Other examples, features, aspects, embodiments, and advantages of the technology will become apparent to those skilled in the art from the following description. As will be realized, the technology described herein is capable of other different and obvious aspects, all without departing from the technology. Accordingly, the drawings and descriptions should be regarded as illustrative in nature and not restrictive.

It will be appreciated the terms "proximal" and "distal" are used herein with reference to the operator who is grasping the driving mechanism, extension member, and light attachment assembly during exemplary use. Therefore "proximal" refers to a position closer to the viewpoint of the operator, while "distal" refers to a position further away from the viewpoint of the operator.

I. Exemplary Light Attachment Assembly

As mentioned above, extension tools may be used to access difficult-to-reach locations such as a bolt or fastener housed within a recessed location having insufficient space to accommodate the driving mechanism. Such recessed locations may be positioned in areas that have less than desirable quantity and/or quality of light, making it difficult for the operator visually inspect the targeted area within the recessed location. Such a visual inspection of the targeted area may be desirable to allow the operator to more easily and accurately attach the driven tool (such as a socket) to the desired bolt or fastener housed within the recessed location.

As also mentioned above, extension tools couple the driving mechanism and the driven tool (such as a socket, Phillips-head screwdriver attachment, etc.) such that driving mechanism also rotates the extension tool. In some instances, extension tools may have a length making it difficult for the operator to accurately control the distal end of the extension tool via grasping the associated driving mechanism with just one hand. Since extension tools rotate along with the driven tool (such as a socket) during exemplary use, grasping the extension tool to better control the placement of the distal end of the extension tool may lead to undesirable consequences. For instance, if the operator is wearing gloves, the frictional force generated between the material of the gloves and the rotating extension tool may cause the gloves to become bound-up, snagged, or otherwise entangled with the extension tool. This may cause injury to the operator or lead to the operator losing control of the extension tool. This problem may be increased if the driving mechanism is motorized such that the extension tool rotates at a relatively high rotations per minute compared to use of a manually actuated driving mechanism.

In some instances, the area defining the difficult-to-reach recessed location may include finished work products, delicate materials, or items that are easy to damage, scratch, or otherwise negatively affect if an extension tool or any item attached to the extension tool (such as a socket) were to accidentally come into contact with such materials. If the operator loses control and/or accurate placement of the distal end of the extension tool during exemplary use, undesirable damage to the area defining the recessed locations may occur.

Therefore, it may be desirable to provide an attachment feature that addresses at least some of the problems described above. Additionally, various extension tools may have different dimensions depending on the manufacturer of the extension tool, the desired use of the extension tool, etc. It may also be desirable to provide an attachment feature that may couple with multiple extension tools of varying dimensions.

FIGS. 1-5 show an exemplary light attachment assembly (10) that may be used in conjunction with a variety of extension tools, driving mechanisms, and driven tools in accordance with the description herein.

FIGS. 7A-9B show light attachment assembly (10) being coupled with and used in conjunction with a driving mechanism (100) coupled with an extension member (110). Driving mechanism (100) includes a coupling portion (102) and a handle portion (104). In the current example, driving mechanism (100) is a ratchet. However, any suitable driving mechanism may be used as would be apparent to one having ordinary skill in the art in view of the teachings herein. For example, torque wrench, a motorized drill, or impact wrench may be used in place of the ratchet.

Figure 7A:
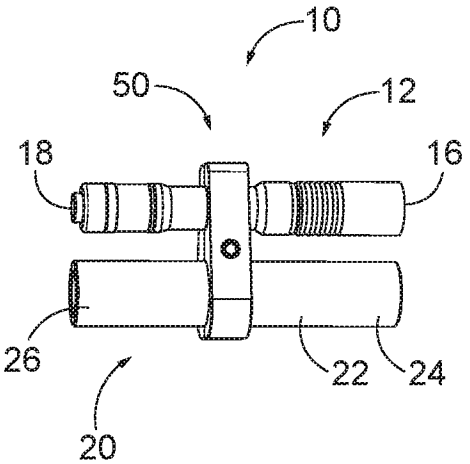
FIG. 7A depicts a top plan view of the light attachment assembly of FIG. 1 being aligned in preparation to couple with an exemplary extension member attached to an exemplary driving mechanism.
Figure 7A:
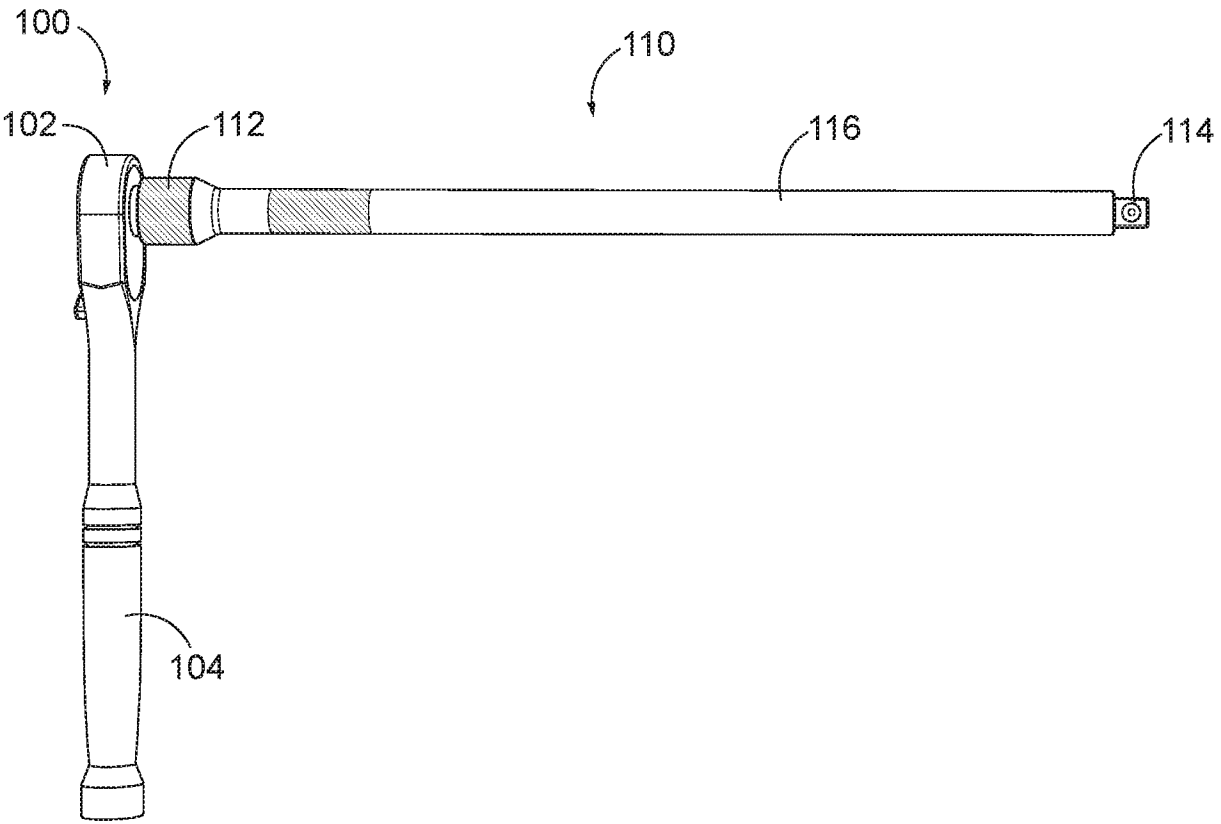

As shown in FIG. 7A, coupling portion (102) is configured to selectively couple with proximal drive coupling (112) of extension member (110). Extension member (110) may couple and decouple with driving mechanism (100) such that various extension members (110) may be attached to driving mechanism (100). Extension member (110) also includes a distal tool coupling (114) and an elongated shaft (116). Distal tool coupling (114) is configured to selectively couple with a driven tool (120), such as a socket shown in FIGS. 7A-10. Of course, distal tool coupling (114) may couple with various type of conversion attachments so that various driven tools (120) having various dimensions may also couple with distal tool coupling (114) via conversion attachments. Handle portion (104) may be grasped by the operator to generate a torque on extension member (110) and driven tool (120).

Turning back to FIGS. 1-5, light attachment assembly (10) includes a flashlight (12), an elongated sheath (20), and a clamp assembly (50). As will be described in greater detail below, clamp assembly (50) is configured to attach flashlight (12) with elongated sheath (20). As will also be described in greater detail below, elongated sheath (20) is dimensioned to slide over elongated shaft (116) of exemplary extension member (110) to suitably couple light attachment assembly (10) to extension member (110) during exemplary use in accordance with the teachings herein.

Flashlight (12) includes a body (14), a light source (16), an activation button (18), and a power source assembly (15). Light source (16) is attached to a distal end of body (14) and is configured to emit light to suitably illuminate a desired location while light attachment assembly (10) is coupled with extension member (110) in accordance with the description herein. Light source (16) may contain any suitable components as would be apparent to one having ordinary skill in the art in view of the teachings herein. Light source (16) may be configured to transition between different sources of light. For example, light source (16) may be configured to transition from a "white light" mode, to a "black light" mode. Therefore, during exemplary use, the operator may be able to switch light modes in order to accentuate or highlight certain features that may be pertinent to the operator.

Activation button (18) is configured to selectively activate light source (16) between an on and off configuration such that light source (16) may selectively transition between emitting light and not emitting light. While in the current example, a button (18) is used to activate light source (16), any other suitable component to activate light source (16) may be used as would be apparent to one having ordinary skill in the art in view of the teachings herein. For example, an activation knob may be used that twists relative to body (14) in order to selectively activate light source (16). Alternatively, a remote control may be implemented, wherein the remote control is in wireless communication with the rest of flashlight (12), such that someone other than the operator grasping light attachment assembly (10) may selectively activate light source (16). Alternatively, flashlight (12) may be configured to be activated by a smart phone via software such that someone other than the operator grasping light attachment assembly (10) may activate light source (16). Additionally, activation button (18), any alternative described above, or any combination described above, may be used to transition between different lighting modes.

Power source assembly (15) is attached to body (14) and is in electrical communication with light source (16). In particular, power source assembly (15) is configured to selectively provide power to light source (16) to illuminate light source (16) in accordance with the description herein. Power source assembly (15) may include any suitable components as would be apparent to one having ordinary skill in the art in view of the teachings herein. Additionally, power source assembly (15) may be rechargeable such that flashlight (12) may be charged while not in use. For example, power source assembly (15) may have a micro Universal Serial Bus (USB) connection configured to selectively couple with an external power source to charge power source assembly (15).

As mentioned above, clamp assembly (50) is configured to attach flashlight (12) with elongated sheath (20). In particular, clamp assembly (50) includes a first body (60), a second body (80), and a set screw (56). First body (60) and second body (80) include respective flashlight clamping surfaces (64, 84) and sheath clamping surfaces (66, 86) that are configured to cooperate with corresponding surfaces of each body (60, 80) to define a flashlight clamping portion (52) and a sheath clamping portion (54). In particular, flashlight (12) is configured to be received within flashlight clamping surfaces (64, 84) while sheath (20) is configured to be received within sheath clamping surfaces (66, 86). Set screw (56) is configured to couple first body (60) and second body (80) such that flashlight clamping surfaces (64, 84) engage body (14) of flashlight (12) to provide a sufficient frictional braking force to affix body (14) relative to clamp assembly (50). Similarly, when set screw (56) couples first body (60) and second body (80) while sheath (20) is between sheath clamping surfaces (66, 86), the frictional braking force between tubular body (22) and sheath clamping surfaces (66, 86) sufficiently affix tubular body (22) relative to clamp assembly (50). Therefore, clamp assembly (50) is configured to affix sheath (20) and flashlight (12) relative to each other.

Figure 4:
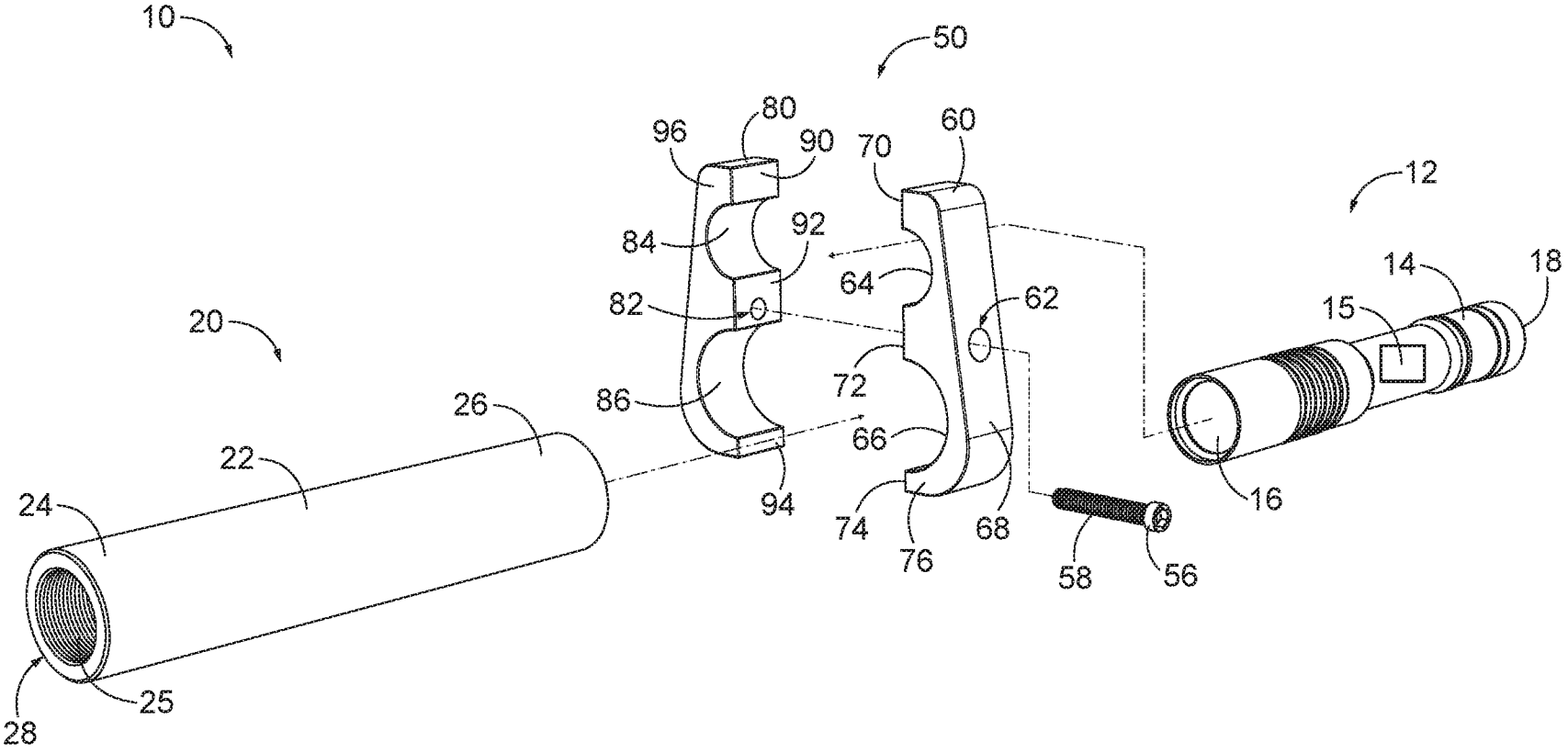
FIG. 4 depicts an exploded perspective view of the light attachment assembly of FIG. 1.
Figure 5:
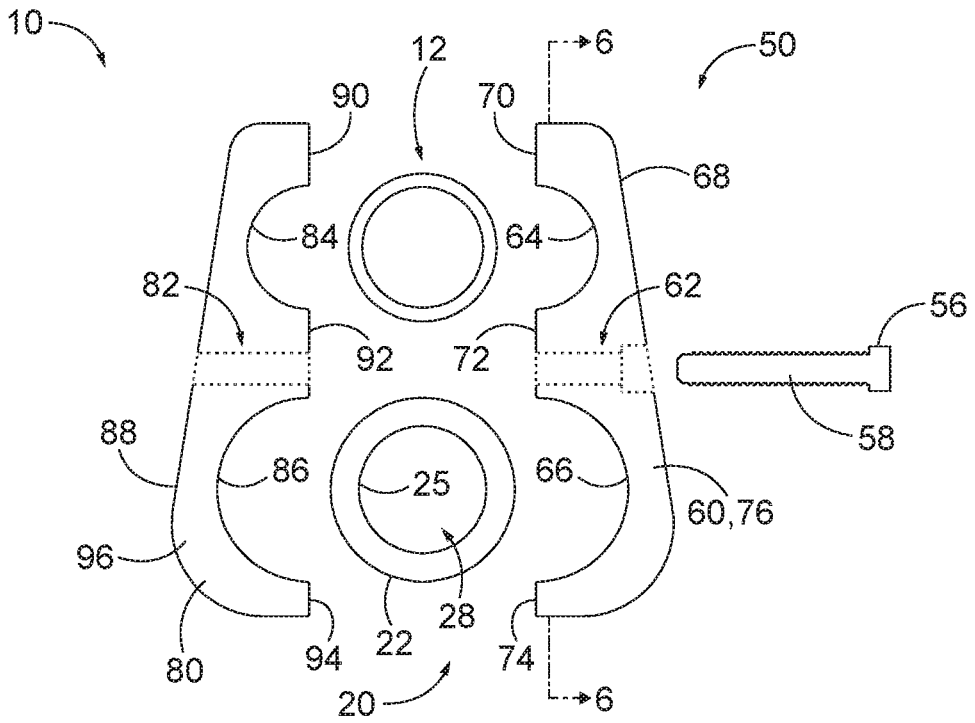
FIG. 5 depicts an exploded front view of the light attachment assembly of FIG. 1.
Figure 6:
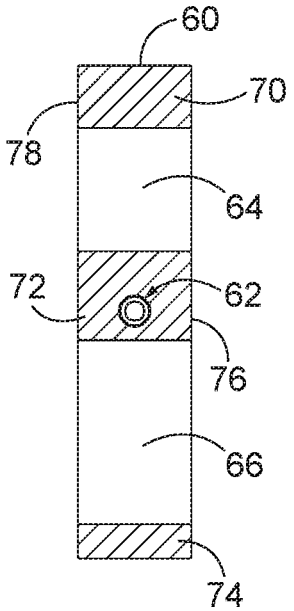
FIG. 6 depicts a cross-sectional view of a first body of a clamp assembly of the light attachment assembly of FIG. 1, taken along line 6-6 of FIG. 5.

First body (60) also includes an exterior facing surface (68), a top interior facing surface (70), an intermediate interior facing surface (72), a bottom interior facing surface (74), a distal facing surface (76), and a proximal facing surface (78). Similarly, second body (80) also includes an exterior facing surface (88), a top interior facing surface (90), an intermediate interior facing surface (92), a bottom interior facing surface (94), a distal facing surface (96), and a proximal facing surface (98). As best seen in FIGS. 4 and 5, top interior facing surfaces (70, 90) may be dimensioned to align with and face each other when first body (60) and second body (80) are suitably coupled in accordance with the description above. Similarly, intermediate interior facing surfaces (72, 92) may be dimensioned to align with and face each other when first body (60) and second body (80) are suitably coupled in accordance with the description above. Bottom interior facing surfaces (74, 94) may be dimensioned to align with and face each other when first body (60) and second body (80) are suitably coupled in accordance with the description above First body (60) and second body (80) are shaped to prevent rolling of sheath (20) and/or flashlight (12) when light attachment assembly (10) is suitably assembled. This may help prevent unwanted movement of flashlight (12) if the operator rests flashlight (12) while coupled with the rest of light attachment assembly (10) on the ground or any other surface.

First body (60) defines a counterbored through hole (62) extending from exterior facing surface (68) through intermediate interior facing surface (72), while second body (80) defines a threaded channel (82) extending from intermediate interior facing surface (92) toward exterior facing surface (88). While in the current example, threaded channel (82) extends all the way to exterior facing surface (88), this is merely optional, as threaded channel (82) may terminate prior to reaching exterior facing surface (88) in some examples.

Counterbored through hole (62) and threaded channel (82) are sufficiently aligned such that set screw (56) may extend through both in order to couple first body (60) with second body (80). Set screw (56) includes a threaded section (58) configured to mesh with the threading of threaded channel (82). Therefore, when the operator desires to couple first body (60) with second body (80), the operator may insert threaded channel (82) through counterbored through hole (62) until threaded channel (82) abuts against threaded channel (82). Then the operator may rotate set screw (56) in a first rotational direction until threaded section (58) meshes with threaded channel (82). Engagement between threaded section (58) and threaded channel (82) due to rotation of set screw (56) in the first rotational direction drives first body (60) and second body (80) toward each other until first body (60) and second body (80) are sufficiently coupled in accordance with the description herein. In particular, as first body (60) and second body (80) are driven toward each other, light clamping surfaces (64, 84) sufficiently engage body (14) of flashlight (12) to provide a sufficient braking/clamping force to affix flashlight (12) relative to first body (60) and second body (80). Similarly, as first body (60) and second body (80) are driven toward each other, sheath clamping surfaces (66, 86) sufficiently engage tubular body (22) of sheath (20) to provide a sufficient braking/clamping force to affix sheath (20) to first body (60) and second body (80). In other words, when first body (60) and second body (80) are sufficiently coupled, and flashlight (12) and sheath (20) are sufficiently housed within their respective clamping portions (52, 54), flashlight (12) and sheath (20) are affixed to each other.

Figure 3A:
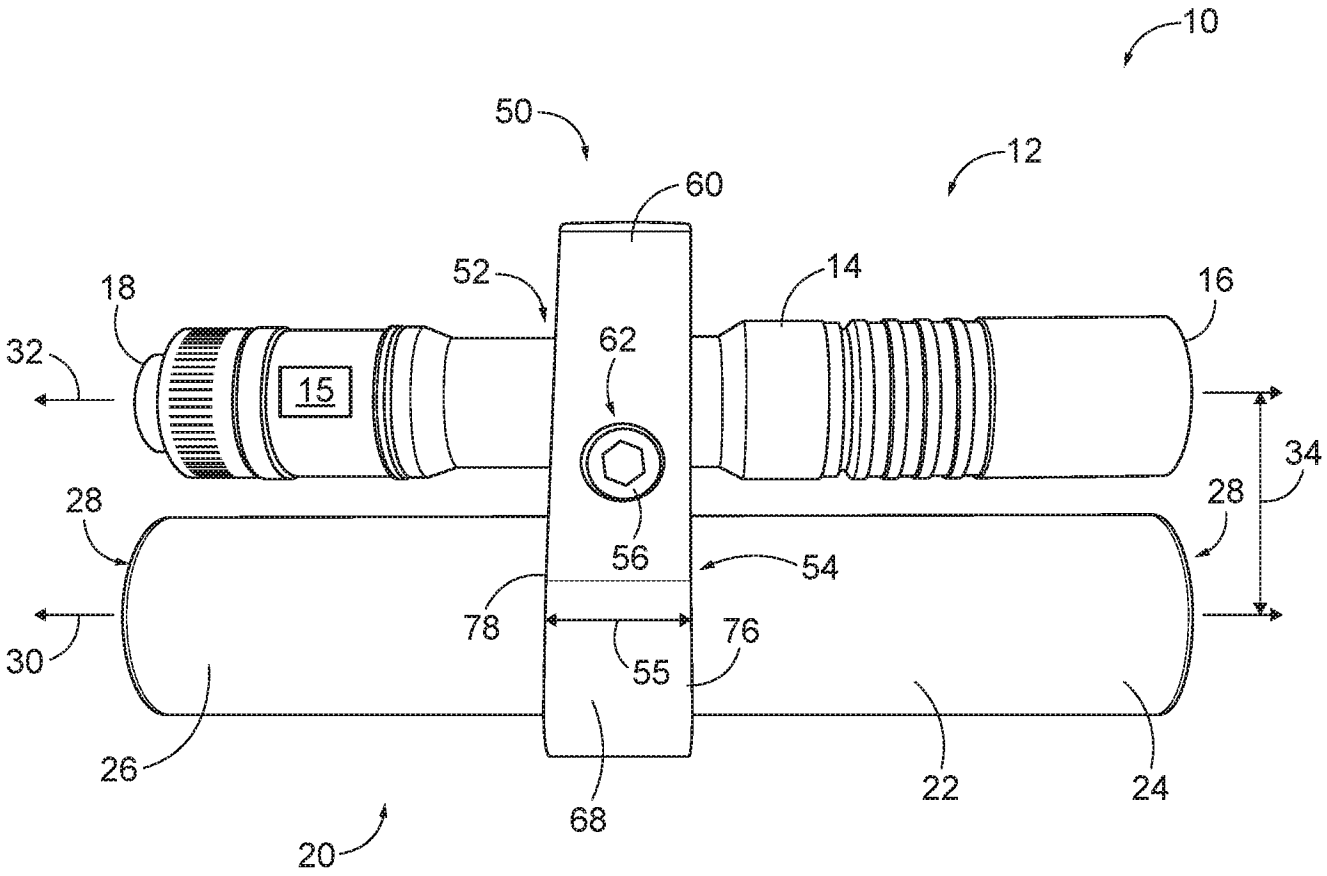
FIG. 3A depicts a top plan view of the light attachment assembly of FIG. 1, wherein a flashlight and an elongated sheath of the light attachment assembly are in a first longitudinal position relative to each other.

As shown in FIG. 3A, sheath (20) may extend along a first longitudinal axis (30) while flashlight (12) may extend along a second longitudinal axis (32) when sheath (20) and flashlight (12) are coupled with clamping assembly (50). First longitudinal axis (30) and second longitudinal axis (32) are spaced an offset distance (34) from each other.

When light attachment assembly (10) is coupled with extension member (110), first longitudinal axis (30) may be substantially aligned with the longitudinal axis of extension member (110) and driven tool (120). In some instances, first longitudinal axis (30) may be offset from the longitudinal axis of extension member (110) due to through hole (28) having a larger inner diameter compared to the outer diameter of extension member (110). In either instance, the offset distance (34) between second longitudinal axis (32) of flashlight (12) and first longitudinal axis (30) of sheath (20) may provide for better illuminated visibility of a desired location as provided from light source (16), as compared to if light source (16) was located coaxially along first longitudinal axis (30) and/or the longitudinal axis of driven tool (120) or extension member (110). Additionally, offset distance (34) may allow for use of flashlight (12) to provide illuminated visibility if driven tool (120) extends along a different longitudinal axis compared to extension member (110), such as when a wobble socket is used.

Any suitable offset distance (34) may be used as would be apparent to one having ordinary skill in the art in view of teachings herein. It should be understood that the offset distance (34) may be determined by the spacing between flashlight clamping portion (52) and sheath clamping portion (54).

In some instances, it may be desirable to longitudinally move flashlight (12) relative to sheath (20) prior to using light attachment assembly (10). For instance, sometimes, it may be desirable to alter the location of gripping light attachment assembly (10) to be more proximal relative to the operator, while it may also be more desirable to alter the location of the light source (16) to be more distal relative to the operator.

Figure 3B:
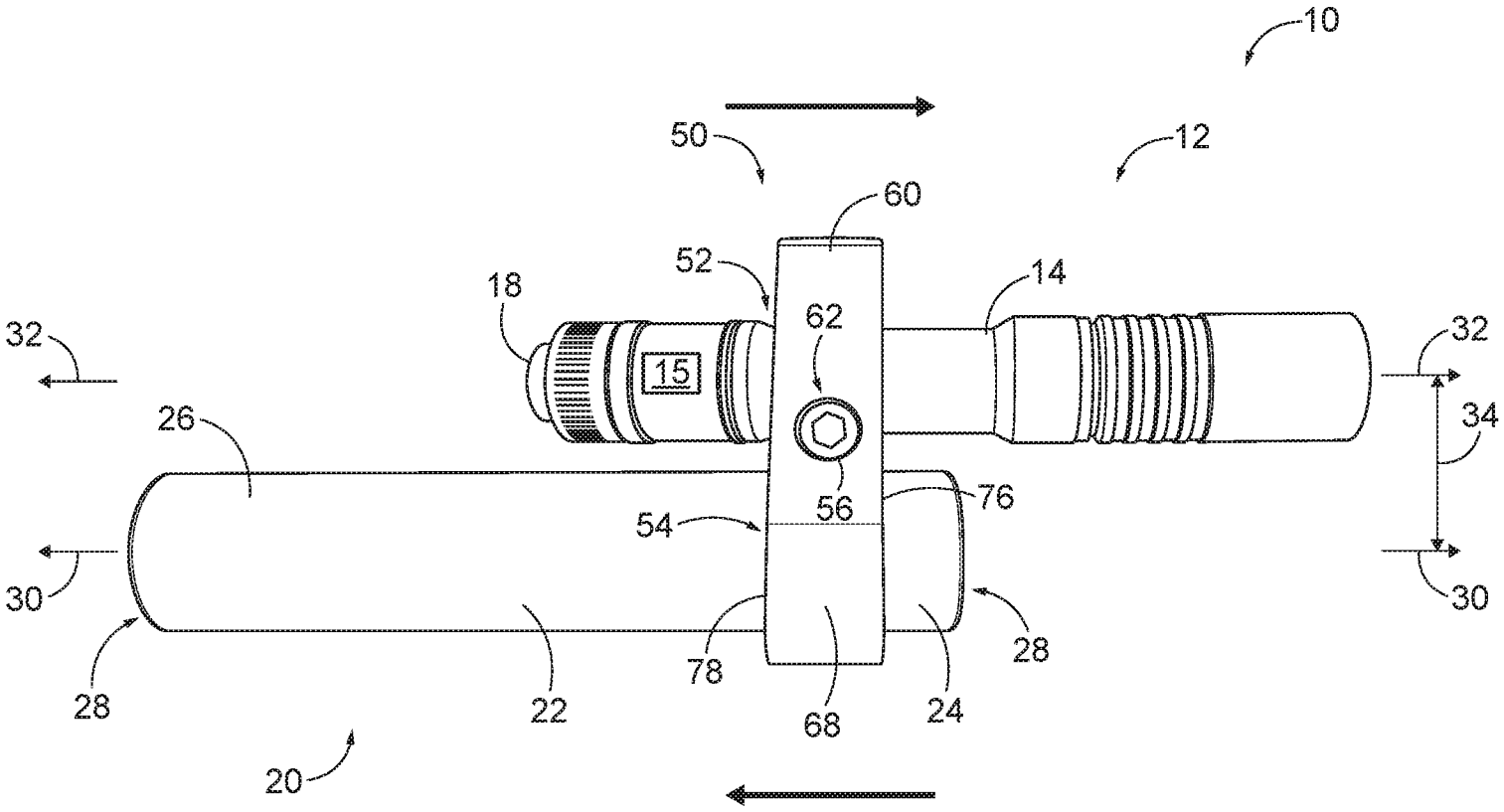
FIG. 3B depicts a top plan view of the light attachment assembly of FIG. 1, wherein the flashlight and the elongated sheath of FIG. 3A are in a second longitudinal position relative to each other.

As shown in FIG. 3A-3B, the operator may adjust the longitudinal positions of both flashlight (12) and sheath (20) relative to clamping assembly (50). For instance, it may be desirable to have flashlight (12) closer to a desired location for viewing purposes, while sheath (20) is closer to the operator for gripping purposes. If adjusting such longitudinal positions is desirable, the operator may loosen set screw (56), by rotating set screw (56) in a second, opposite rotational direction (compared to the first rotational direction of set screw (56) described above) to reduce the amount of fictional braking force provided by both light clamping surfaces (64, 84) and sheath clamping surface (66, 86). With the frictional braking forces reduced, the operator may adjust the longitudinal location of both flashlight (12) and sheath (20). Once flashlight (12) and sheath (20) are positioned relative to clamping assembly (50), the operator may re-tighten set screw (56) by rotating set screw (56) in the first rotational direction to increase the frictional braking forces of both light clamping surfaces (64, 84) and sheath clamping surface (66, 86), thereby reaffixing flashlight (12) and sheath (20) to clamping assembly (50).

While a set screw (56) is used to couple first body (60) and second body (80) together, any other suitable coupling mechanism may be used as would be apparent to one having ordinary skill in the art in view of the teachings herein. For example, first body (60) and second body (80) may be complementary camming features and when aligned and rotated relative to each other, first body (60) and second body (80) are driven toward each other such that light clamping surfaces (64, 84) and sheath clamping surface (66, 86) provide a sufficient braking force in accordance with the description herein.

As mentioned above, elongated sheath (20) is dimensioned to slide over elongated shaft (116) of extension member (110) to suitably couple light attachment assembly (10) to extension member (110) during exemplary use. Elongated sheath (20) includes a tubular body (22) extending between a distal portion (24) and a proximal portion (26). Tubular body (22) includes an interior surface (25) that defines a through hole (28) extending all the way from the terminating end of the distal portion (24) to the terminating end of the proximal portion (26).

Figure 7B:
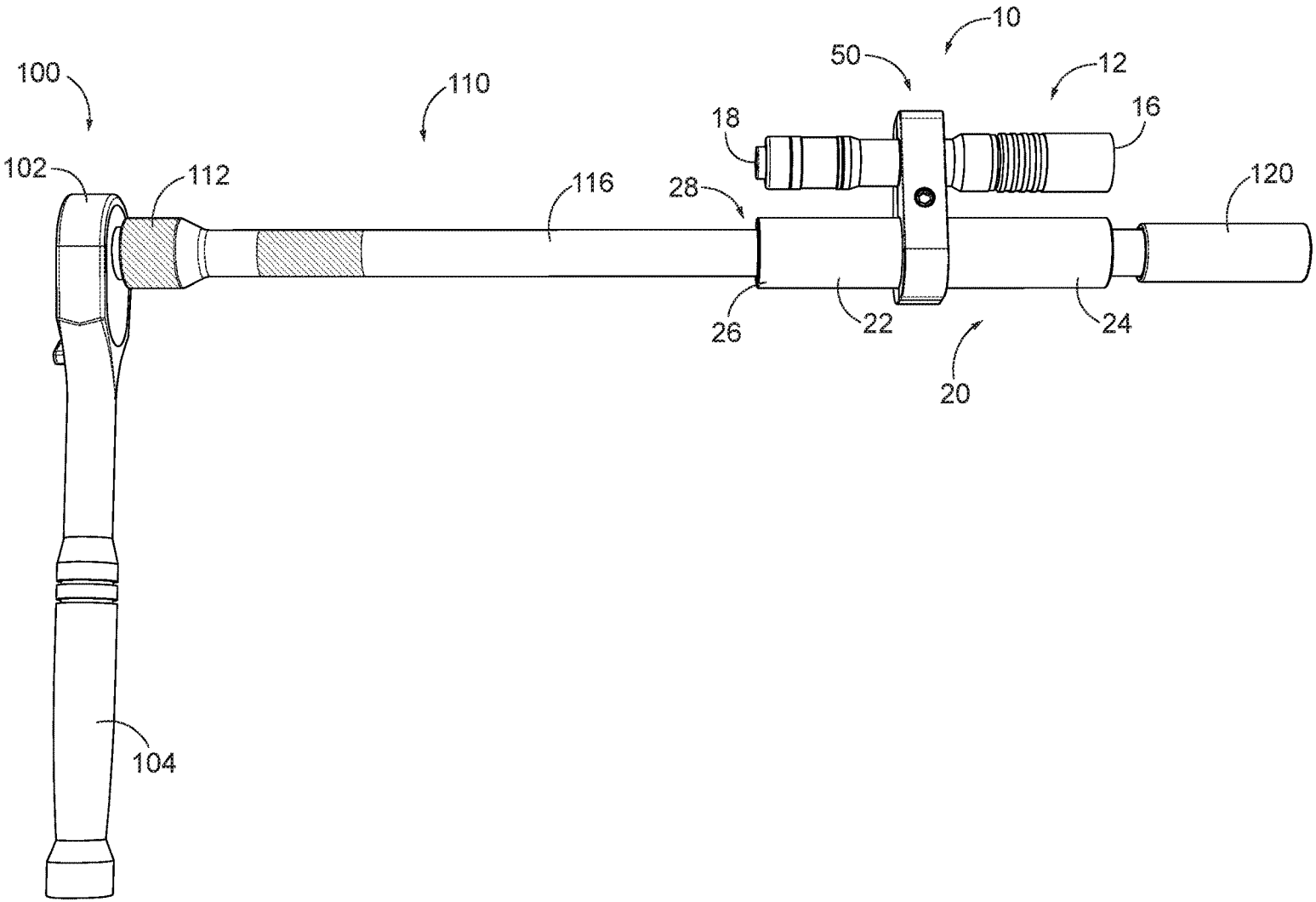
FIG. 7B depicts a top plan view of the light attachment assembly of FIG. 1 coupled with the extension member of FIG. 7A, where the light attachment assembly is in a first longitudinal position and a first rotational position relative to the extension member, where a distal end of the extension member is coupled with an exemplary socket.
Figure 7C:
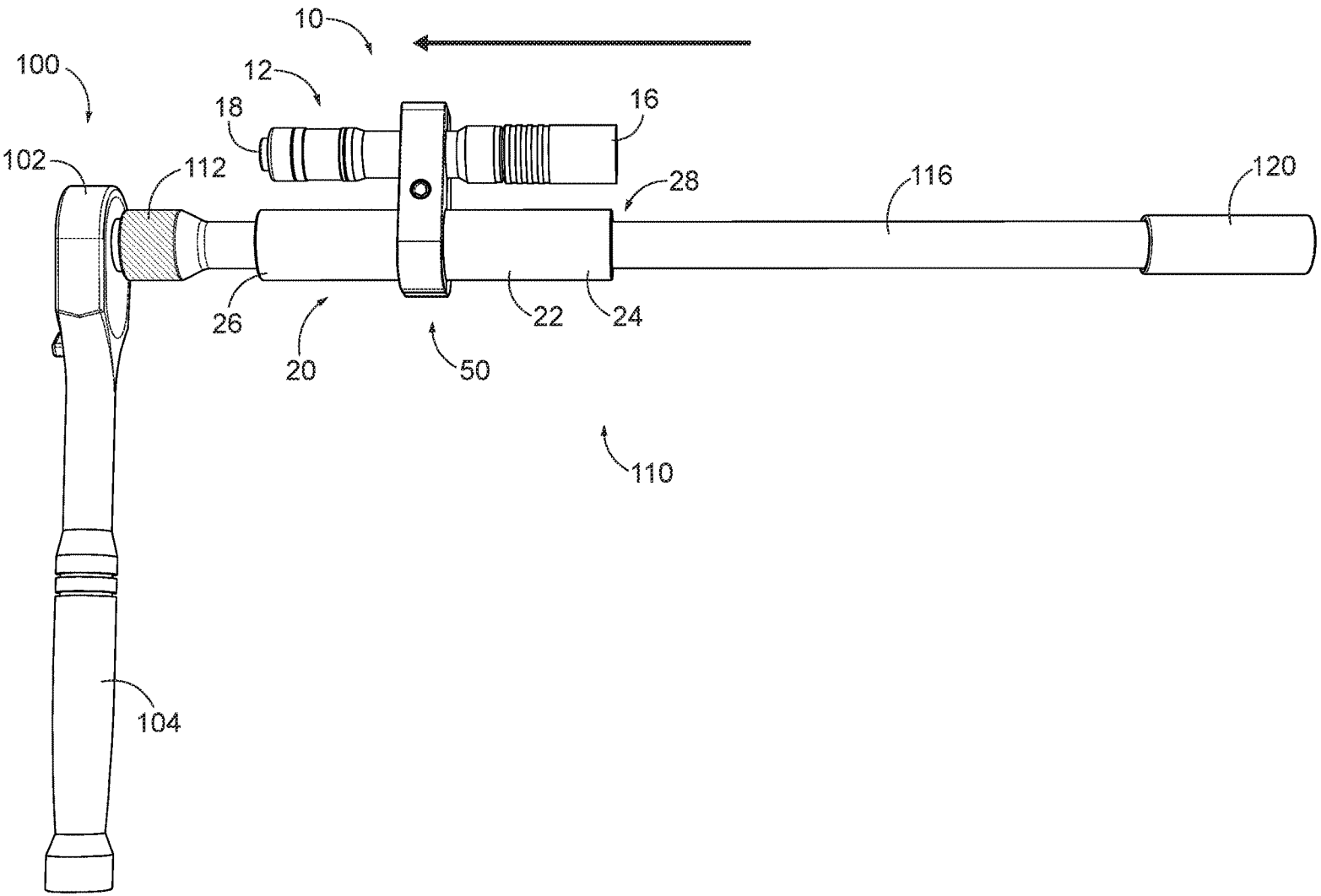
FIG. 7C depicts a top plan view of the light attachment assembly of FIG. 1 coupled with the extension member of FIG. 7A, where the light attachment assembly is in a second longitudinal position and the first rotational position relative to the extension member, where the distal end of the extension member is coupled with the socket of FIG. 7B.
Figure 8A:
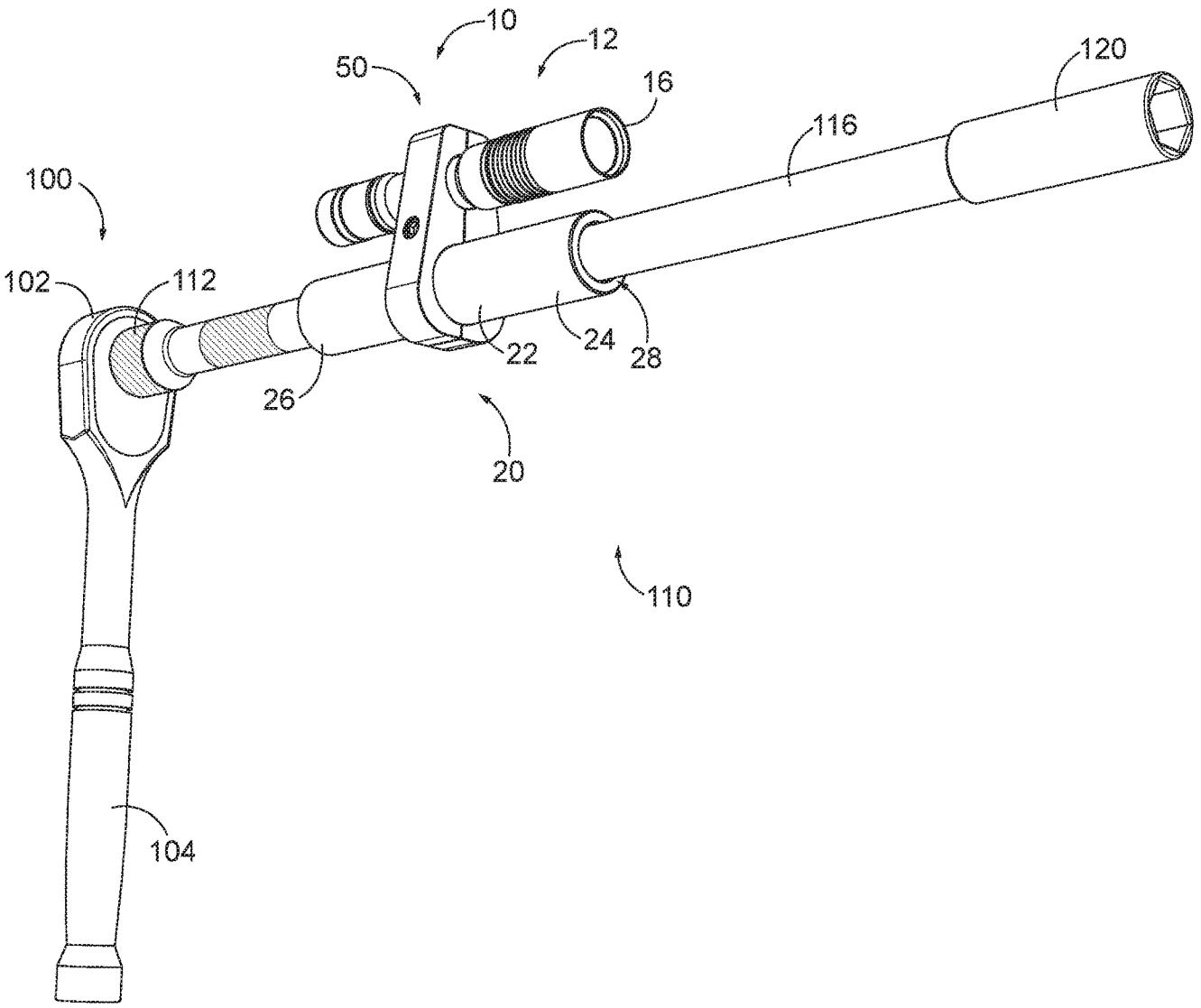
FIG. 8A depicts a perspective view of the light attachment assembly of FIG. 1 coupled with the extension member of FIG. 7A, where the light attachment assembly is in the second longitudinal position and the first rotational position relative to the extension member, where the distal end of the extension member is coupled with the socket of FIG. 7B.
Figure 8B:
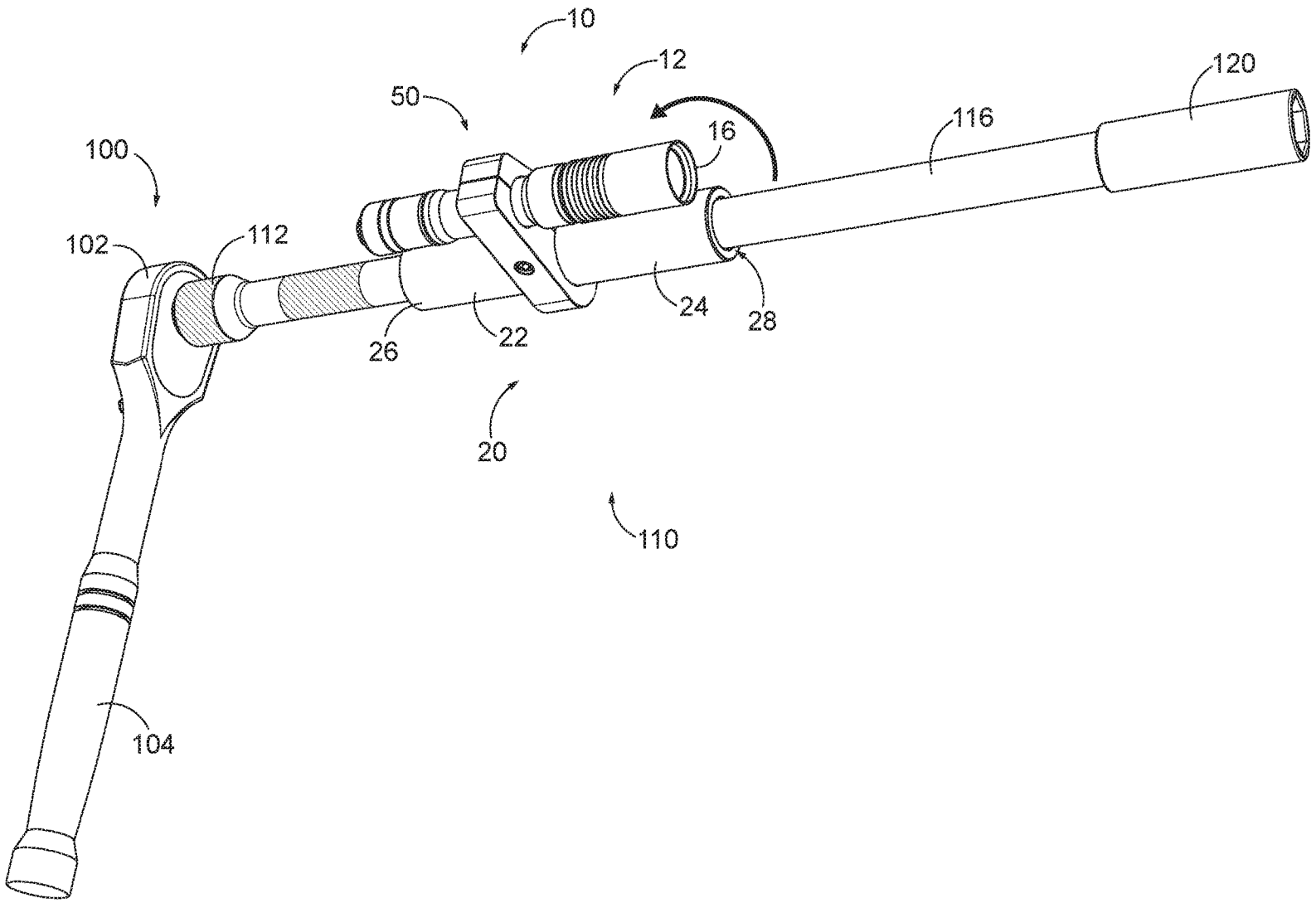
FIG. 8B depicts a perspective view of the light attachment assembly of FIG. 1 coupled with the extension member of FIG. 7A, where the light attachment assembly is in the second longitudinal position and a second rotational position relative to the extension member, where the distal end of the extension member is coupled with the socket of FIG. 7B.
Figure 8C:
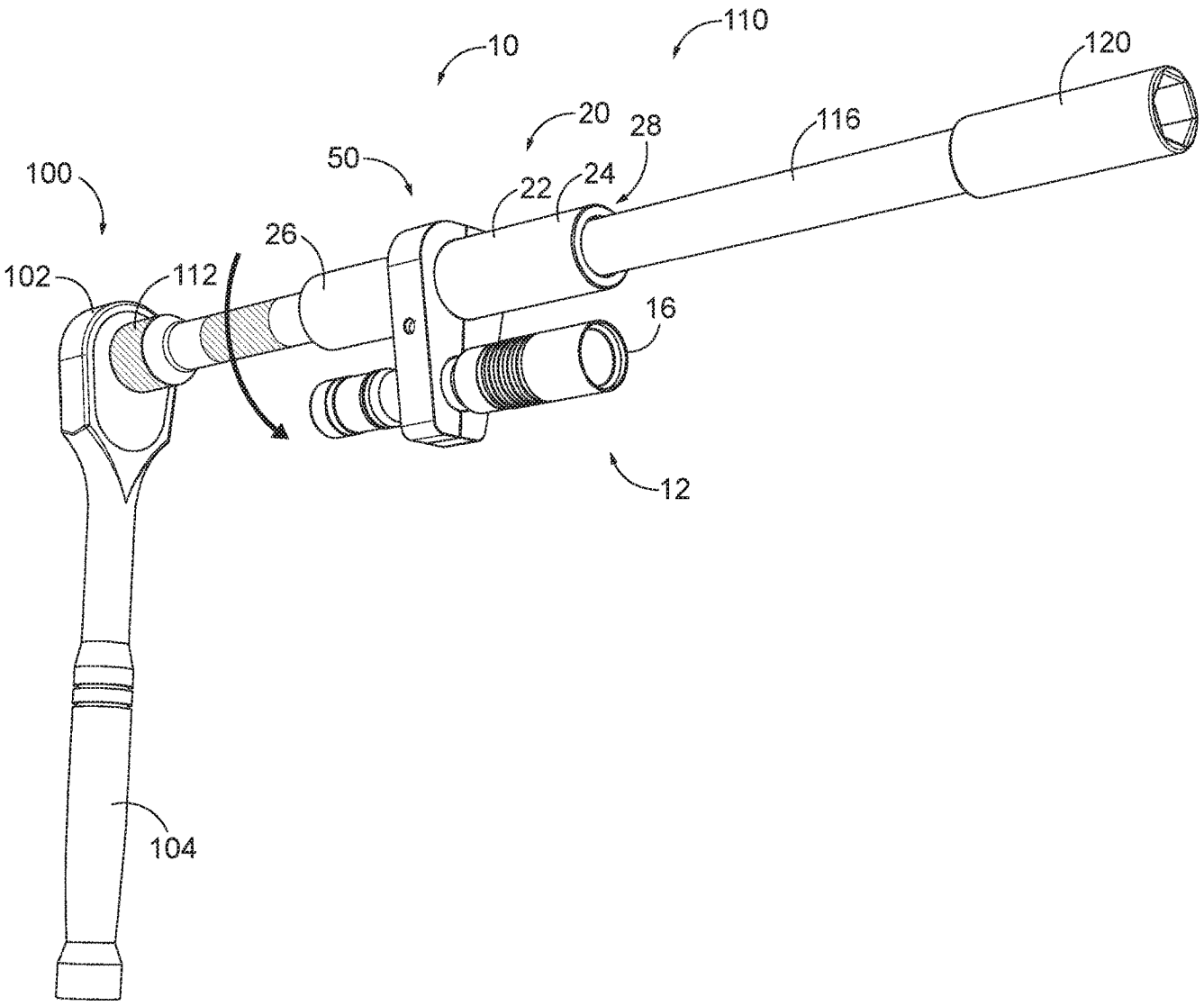
FIG. 8C depicts a perspective view of the light attachment assembly of FIG. 1 coupled with the extension member of FIG. 7A, where the light attachment assembly is in the second longitudinal position and a third rotational position relative to the extension member, where the distal end of the extension member is coupled with the socket of FIG. 7B.

As shown between FIGS. 7A-7B, through hole (28) is dimensioned to slide over a proximal drive coupling (112) of extension member (110) to slidably and rotatably attach sheath (20) to elongated shaft (116) of extension member (110). Elongated sheath (20) is long enough to be grasped by the operator during exemplary use such that the operator does not need to sufficiently grasp elongated shaft (116) of extension member (110) during exemplary use. Therefore, during exemplary use, the operator may use one hand to grasp a driving mechanism (100), while using a second hand to grasp elongated sheath (20) of light attachment assembly (10). This may allow the operator to precisely place extension member (110) in a desired location during exemplary use. This may also allow the operator to precisely control and maintain the location of extension member (110) in the directed location during exemplary use.

Through hole (28) may be sized to accommodate different extension members (110) having various outer diameters. As will be described in greater detail below, the inner diameter of through hole (28) is at least slightly larger than the outer diameter of elongated shaft (116) such that when sheath (20) is suitably coupled with elongated shaft (116) of extension member (110), elongated sheath (20) is free to rotate about the longitudinal axis of elongated shaft (116); while elongated sheath (20) is also free to slide along at least a portion of the length of elongated shaft (116). In other words, the frictional force from contact between interior surface (25) of elongated sheath (20) and the exterior surface of elongated shaft (116) is not too great as to inhibit movement (either rotational or translational) of elongated sheath (20) relative to extension member (110) or vice versa. Therefore, during exemplary use (as shown between FIGS. 7B-7C), the operator may adjust the longitudinal position of light attachment assembly (10) relative to extension member (110) by pushing or pulling light attachment assembly (10); while (as shown between FIGS. 8A-8C) the operator may adjust the rotational position of light attachment assembly (10) relative to extension member (110) by rotating/twisting light attachment assembly (10).

Additionally, as extension member (110) is rotated about its own axis in accordance with the description herein, light attachment assembly (10) may not be driven rotationally by the movement of extension member (110). This may prevent light attachment assembly (10) from accidentally rotating with extension member (110), which may be beneficial, especially if extension member (110) is rotating at a relatively high rotations per minute.

The operator may maintain the longitudinal and rotational position of light attachment assembly (10) by continuing to grasp light attachment assembly (10). It should be understood that grasping light attachment assembly (10) may also allow the operator to control the placement of extension member (110) simultaneously. This ease of placement of light attachment assembly (10) may allow the operator to easily place light source (16) at a desired location for optimal illuminated visibility of a desired location.

It should be understood that elongated sheath (20) may remain slidably and rotatably coupled with extension member (110) until interior surface (25) of sheath (20) is no longer sufficiently longitudinally aligned with a suitable portion of extension member (110). In other words, the contact between interior surface (25) of sheath (20) and the outer surface of extension member (110) may allow extension member (110) (while in substantial horizontal alignment) to support light attachment assembly (10). Therefore, when light attachment assembly (10) is suitably coupled with extension member (110), and extension member (110) is held in a substantially horizontal orientation, light attachment assembly (10) may hang from extension member (110).

It should be understood that since sheath (20) is free to slide relative to extension member (110) such that if the operator pointed distal tool coupling (114) of extension member (110) toward the ground without a sufficient driven tool (120) attached, gravity will cause light attachment assembly (10) to slide toward distal tool coupling (114) until light attachment assembly (10) falls off extension member (110). Through hole (28) may be sized smaller than a driven tool (120) (such as a socket) that couples to distal tool coupling (114) of extension member (110) (as shown in FIG. 7B). Therefore. if driven tool (120) is attached to distal tool coupling (114) while sheath (20) is slidably coupled on extension member (110), contact between driven tool (120) and distal portion (24) of sheath (20) will prevent sheath (20) from falling off extension member (110).

Figure 10:
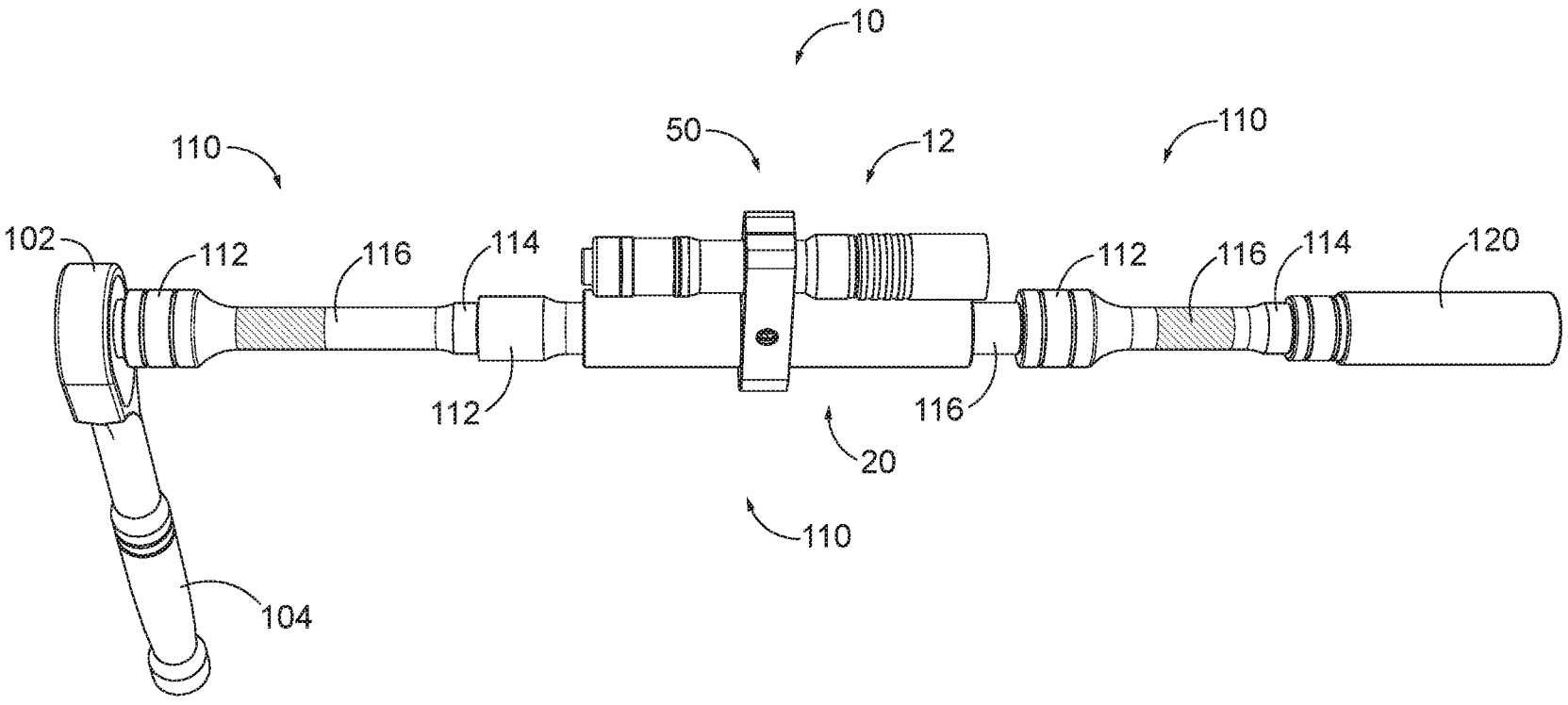
FIG. 10 depicts a perspective of the light attachment assembly of FIG. 1 coupled with an intermediate extension member of a linear array of extension members coupled with the socket of FIG. 7B and the driving mechanism of FIG. 7A.

As shown in FIG. 10, in some instances, multiple extension members (110) may be attached to each other in a linear array such that drive coupling (112) of a proximal extension member (110) is coupled with driving mechanism (100), and tool coupling (114) of a distal extension member (110) is coupled with a driven tool (120). Adjacent extension members (110) may be coupled with each other via proximal drive couplings (112) and distal tool couplings (114). Any suitable number of extension members (110) may be used as would be apparent to one having ordinary skill in the art in view of the teachings herein. In the current example, three extension members (110) are used. Light attachment assembly (10) may be suitably attached to any elongated shaft (116) within the chain of extension members (110). In the current example, light attachment assembly (10) is attached to the intermediary extension member (110).

Proximal drive couplings (112) may be dimensioned larger than the interior diameter of through hole (28) of sheath (20), thereby longitudinally constraining sheath (20), and the rest of light attachment assembly (10), along a corresponding elongated shaft portion (116) between adjacent drive couplings (112) of corresponding extension members (110). Therefore, multiple extension members (110) may be utilized to constrain the longitudinal movement of light attachment assembly (10). In other words, proximal drive couplings (112) may act as an obstructing object to constrain translation of light assembly (10) along a predetermined longitudinal path.

In some instances, a separate obstructing object may be coupled with an exterior of elongated shaft portion (116) to constrain translation of light assembly (10) along a predetermined longitudinal path. Any suitable obstructing object may be used as would be apparent to one skilled in the art in view of the teachings herein. For example, a magnet may be attached to a desired location on elongated shaft portion (116). The cross-sectional dimension of the magnet and the corresponding portion of elongated shaft portion (116) may be larger than the through hole (28) of sheath (20). Multiple obstructing objects may be used along different portions of elongated shaft (116) to create a customized range of longitudinal travel, similar to the use of multiple extension members (110) shown in FIG. 10.

It should be understood that since sheath (20) is free to rotate relative to extension member (110), if the operator let go of light attachment assembly (10) (while extension member (110) is in a substantially horizontal orientation or while driven tool (120) is coupled with distal tool coupling (114)), the light attachment assembly (10) may rotate relative to extension member (110) until the top heavy portion of light attachment assembly (10) is on the bottom (i.e., closest to the ground) due to the influence of gravity.

As also mentioned above, elongated sheath (20) is long enough to be grasped by the operator during exemplary use such that the operator does not overly grasp elongated shaft (116) of extension member (110) during exemplary use. Therefore, as shown between FIGS. 9A-9B, when the operator desires to rotate driven tool (120) and extension member (110) via rotation of driving mechanism (100), the operator may grasp sheath (20) in order to control the placement of extension member (110) and driven tool (120). Since extension member (110) is free to rotate relative to sheath (20), the hand of the operator may be protected from contacting rotating extension member (110). Additionally, the capability of grasping extension member (110) during exemplary use via sheath (20) may provide more precise control and placement of extension member (110) and driven tool (120).

While in the current example, tubular body (22) has a fully enclosed perimeter (as shown in FIG. 5), this is not required. Tubular body (22) may have any suitable perimeter such that when through hole (28) receives elongated shaft (116) of extension member (110), contact between interior surface (25) of sheath (20) and the outer surface of extension member (110) may allow extension member (110) to support elongated sheath (20) and the rest of light attachment assembly (10) (at least when extension member (110) is in the substantially horizontal orientation). For instance, tubular body (22) may have an elongated slot extending along any suitable length or in any suitably angular orientation along tubular body (22). Such a slot may allow portions of tubular body (22) to flex relative to each other, such that tubular body (22) may accommodate extension members (110) with larger or smaller diameters.

The slot along tubular body (22) and/or the portion of clamp assembly (50) defining sheath clamping portion (54) may be configured to flex toward and away from each other in order to couple with elongated shaft (116) of extension member (110) while driven tool (120) is already attached to extension member (110) in accordance with the description herein. For instance, the slot along tubular body (22) may expand under sufficient force such that elongated shaft (116) may fit through the slot and couple within sheath (20). The portion of sheath (20) defining slot may be sufficiently resilient such that sheath (20) may return to a non-expanded state when no longer under sufficient force such that tubular body (22) is then slidably attached to elongated shaft (116).

In some instances, flashlight (12) may be readily integrated into either clamp assembly (50) and/or sheath (20) such that an individual flashlight (12) and/or clamp assembly (50) is no longer required. For example, body (14) of flashlight (12) may be integrated into tubular body (22) such that tubular body (22) contains all the necessary components for an operating flashlight (12). As such, light source (16) may include an annular array of LED lights disposed on the distal end (24) of tubular body (22). In such instances, offset distance (34) would be the radial distance between the center of tubular body (22) and the location of LED lights disposed on the distal end (24) of tubular body (22). In such an example, clamp assembly (50) may be omitted entirely. In some instances, flashlight (12) may be fixed to and extend from an exterior surface of a portion of elongated sheath (20) such that clamp assembly (50) may be omitted entirely.

In some instances, light attachment assembly (10) may be coupled to any suitable structure for storage or accessibility purposes. For instance, light attachment assembly (10) may be coupled to a self-standing structure via a reusable tie strap, a twist tie, or any other suitable coupling device that would be apparent to one skilled in the art in view of the teachings herein.

II. Exemplary Use of Light Attachment Assembly

As mentioned above, FIGS. 7A-9B show an exemplary use of light attachment assembly (10) with driving mechanism (100), extension member (110), and driven tool (120). In order to couple light attachment assembly (10) with extension member (110), the operator may align through hole (28) at proximal portion (26) of sheath (20) with distal tool coupling (114) of extension member (110), as shown in FIG. 7A. Next, as shown in FIG. 7B, the operator may slide sheath (20) over top distal tool coupling (114) such that distal portion (24) of sheath (20) is sufficiently proximal relative to distal tool coupling (114). At this point, the operator may attach driven tool (120) to extension member (110) via distal tool coupling (114). The operator may activate light source (16) in accordance with the description above to illuminate areas adjacent to driven tool (120). The operator may activate light source (16) at any time during use of light attachment assembly (10).

As described above, driven tool (120) may prevent sheath (20) from accidentally sliding off extension member (110). Once suitably coupled, the operator may adjust the longitudinal distance of light attachment assembly (10), as shown between FIGS. 7B-7C in order to adjust the position of light source (16) and/or the grip of extension member (110). Additionally, as described above, the operator may adjust the rotational position of light attachment assembly (10), as shown between FIGS. 8A-8C to adjust the position of light source (16) and/or the grip of extension member (110). It should be understood that light attachment assembly (10) may rotate 360 degrees around the longitudinal axis of extension member (110).

Figure 9A:
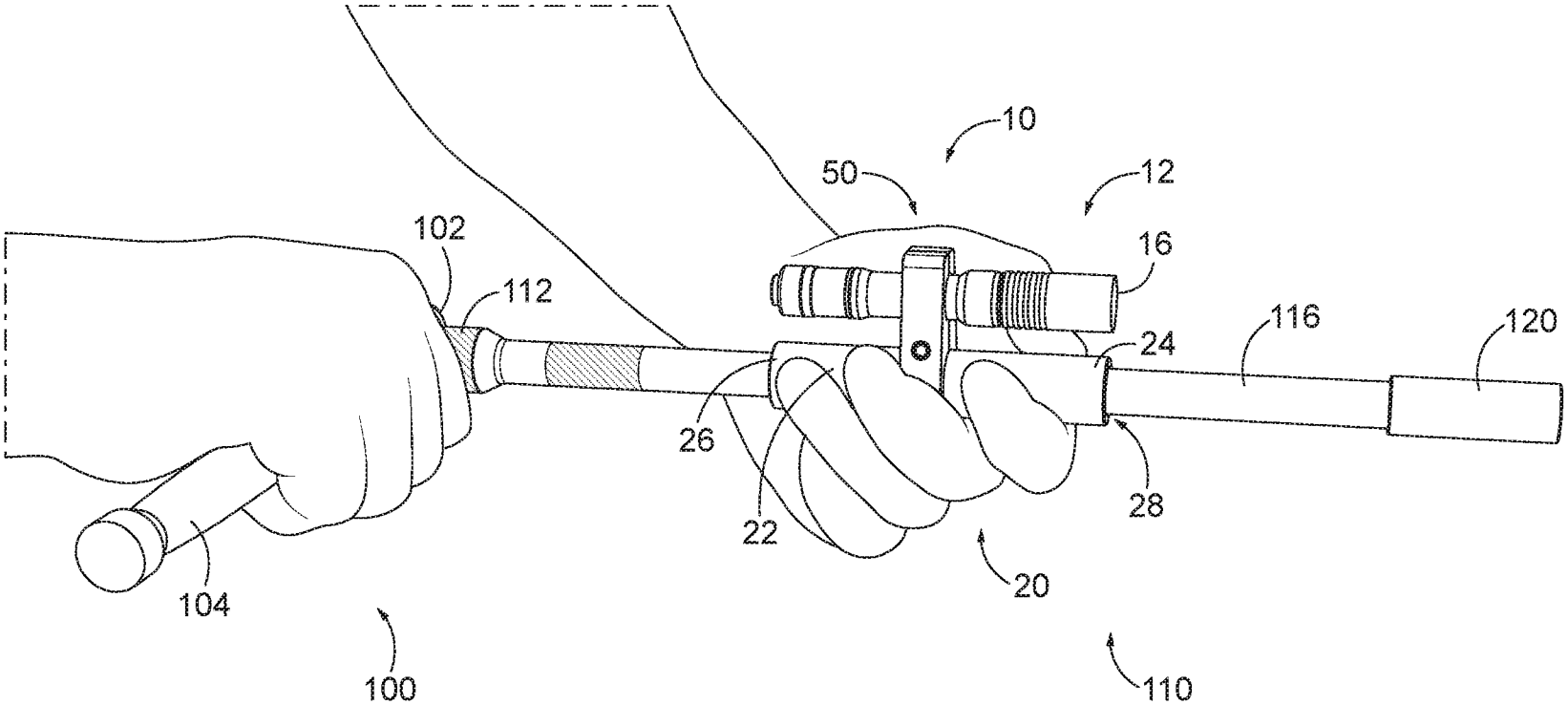
FIG. 9A depicts a perspective view of the light attachment assembly of FIG. 1 coupled with the extension member of FIG. 7A, where the distal end of the extension member is coupled with the socket of FIG. 7B, where an operator is grasping the light attachment assembly with one hand and the driving mechanism of FIG. 7A with the other hand.
Figure 9B:
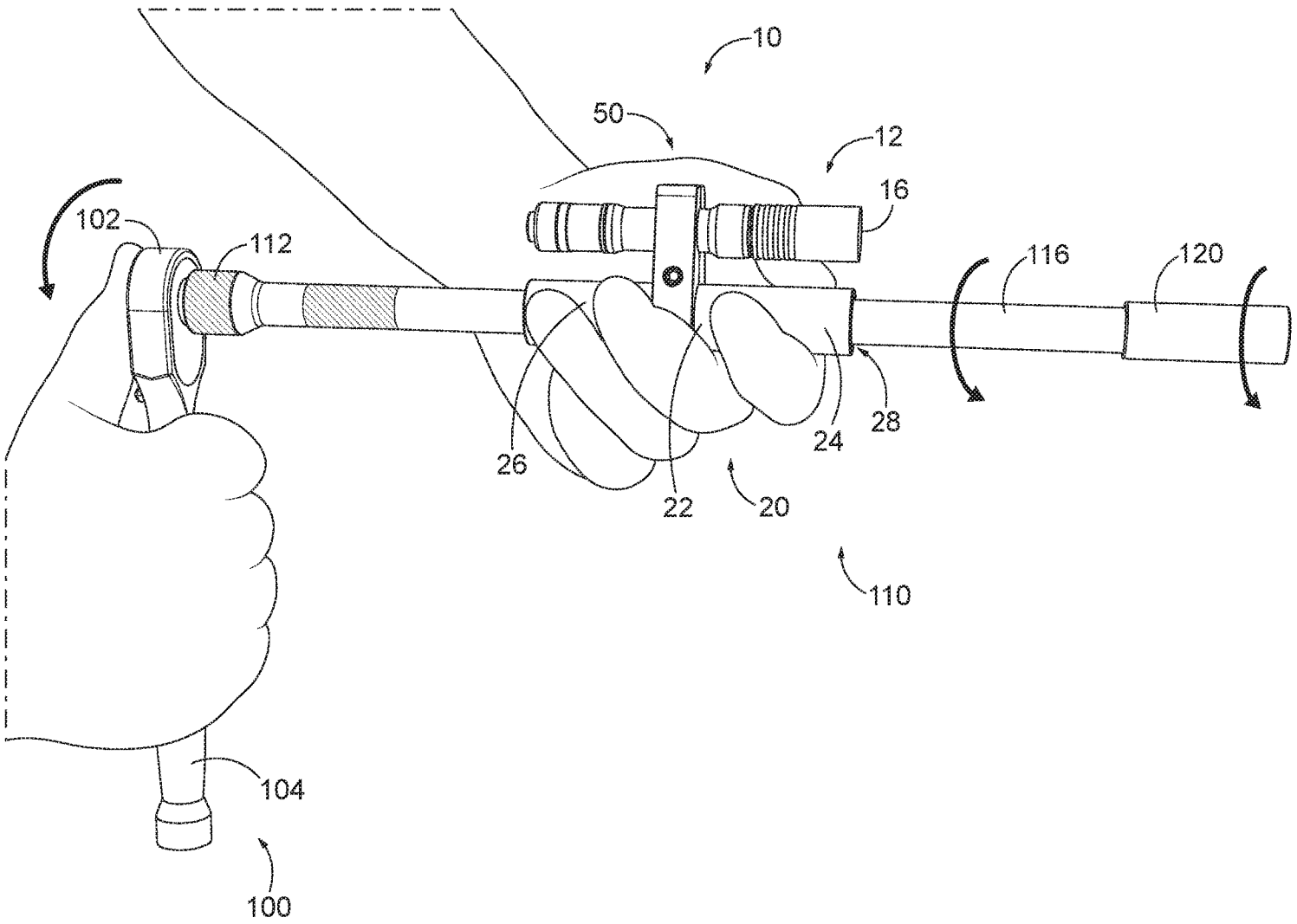
FIG. 9B depicts a perspective view of the light attachment assembly of FIG. 1 coupled with the extension member of FIG. 7A, where the distal end of the extension member is coupled with the socket of FIG. 7B, where the operator is grasping light attachment assembly with one hand and the driving mechanism of FIG. 7A with the other hand, where the operator has rotated the driving mechanism, extension member, and socket relative to the light attachment assembly during exemplary use.

As shown between FIGS. 9A-9B, once driven tool (120) is suitably positioned, the operator may drive rotation of extension member (110) and driven tool (120). It should be understood that sheath (20) may allow the operator to control extension member (110) without being subjected to the rotation of extension member (110), as shown in FIG. 9B. Driven tool (120) may be rotated to perform any number of suitable tasks as would be apparent to one having ordinary skill in the art in view of the teachings herein. It should be understood that light source (16) may help illuminate a desired location to allow the operator to accurately place driven tool (120) within the desired location. In some instances, light source (16) is used while attached to extension member (110) to simply visually assess an area prior to placing a driven tool (120) within that area.

Once a task is completed, the operator may remove driven tool (120) and then remove light attachment assembly (10) from extension member (110) if desired. The operator may then couple light attachment assembly (10) with a different extension member (110) having different dimensions.

III. Miscellaneous

It should also be understood that any one or more of the teachings, expressions, embodiments, examples, etc. described herein may be combined with any one or more of the other teachings, expressions, embodiments, examples, etc. that are described herein. The above-described teachings, expressions, embodiments, examples, etc. should therefore not be viewed in isolation relative to each other. Various suitable ways in which the teachings herein may be combined will be readily apparent to those of ordinary skill in the art in view of the teachings herein. Such modifications and variations are intended to be included within the scope of the claims.

It should be appreciated that any patent, publication, or other disclosure material, in whole or in part, that is said to be incorporated by reference herein is incorporated herein only to the extent that the incorporated material does not conflict with existing definitions, statements, or other disclosure material set forth in this disclosure. As such, and to the extent necessary, the disclosure as explicitly set forth herein supersedes any conflicting material incorporated herein by reference. Any material, or portion thereof, that is said to be incorporated by reference herein, but which conflicts with existing definitions, statements, or other disclosure material set forth herein will only be incorporated to the extent that no conflict arises between that incorporated material and the existing disclosure material.

Having shown and described various embodiments of the present invention, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, the examples, embodiments, geometrics, materials, dimensions, ratios, steps, and the like discussed above are illustrative and are not required. Accordingly, the scope of the present invention should be considered in terms of the following claims and is understood not to be limited to the details of structure and operation shown and described in the specification and drawings.

I claim:

1. A light attachment assembly configured to selectively couple to an elongated extension tool, the light attachment assembly comprising:

(a) an elongated sheath extending along a first longitudinal axis between a proximal end and a distal end, wherein the elongated sheath defines a through hole extending between the proximal end and the distal end, wherein the through hole is dimensioned to slidably receive the elongated extension tool such that the light attachment assembly may rotate and translate relative to at least a portion of the elongated extension tool;

(b) a light source extending along a second longitudinal axis, wherein the light source is configured to transition between an activated state and a deactivated state; and (c) a clamping assembly configured to fix the elongated sheath with the light source, wherein the clamping assembly comprises:

(i) a first body, wherein the first body comprises a first sheath clamping surface and a first light source clamping surface, and (ii) a second body, wherein the second body comprises a second sheath clamping surface and a second light source clamping surface, wherein the first sheath clamping surface and the second sheath clamping surface are configured to cooperatively engage the elongated sheath to fix the elongated sheath relative to the clamping assembly, wherein the first light source clamping surface and the second light source clamping surface are configured to cooperatively engage the light source to fix the light source relative to the clamping assembly, thereby fixing the light source relative to the elongated sheath, wherein the elongated sheath is adjustable along the first longitudinal axis relative to the clamping assembly such that the clamping assembly is configured to selectively engage a first longitudinal portion of the elongated sheath and a second longitudinal portion of the elongated sheath to couple with the elongated sheath in a first configuration and a second configuration, respectively.

2. The light attachment assembly of claim 1, wherein the clamping assembly further comprises a set screw configured to couple the first body and the second body such that the clamping assembly may fix the light source relative to the elongated sheath.

3. The light attachment assembly of claim 1, wherein the light source is adjustable along the second longitudinal axis relative to the clamping assembly.

4. The light attachment assembly of claim 1, wherein the elongated sheath is longer than the clamping assembly.

5. The light attachment assembly of claim 1, wherein the light source comprises an activation button.

6. A light attachment assembly configured to selectively couple to an elongated extension tool, the light attachment assembly comprising:

(a) an elongated sheath extending along a sheath axis, wherein the elongated sheath defines a hollow portion dimensioned to slidably and rotatably couple with the elongated extension tool, wherein the elongated sheath is configured to remain rotationally stable as the elongated extension tool, while coupled with the elongated sheath, is rotated about a longitudinal axis defined by the elongated extension tool;

(b) a light source configured to transition between an activated state and a deactivated state, wherein the light source is coupled with the elongated sheath such that the light source is configured to rotate and slide along with the elongated sheath relative to the elongated extension tool; and (c) a clamping assembly configured to selectively fix the elongated sheath with the light source, wherein the clamping assembly is configured to selectively attach to the elongated sheath at multiple locations along the sheath axis.

7. The light attachment assembly of claim 6, wherein the clamping assembly further comprises a first complementary clamping body, a second complementary clamping body, and a set screw configured to attach the first complementary clamping body with the second complementary clamping body.

8. The light attachment assembly of claim 6, wherein the elongated sheath comprises a tubular body.

* * * * *